United States Patent [19]

Kahn

[11] Patent Number: 4,981,228

[45] Date of Patent: Jan. 1, 1991

[54] BOTTLE OPENER AND CLOSURE CAP

[76] Inventor: Richard M. Kahn, P.O. Box 309, Engelhard, N.C. 27885

[21] Appl. No.: 310,886

[22] Filed: Feb. 16, 1989

[51] Int. Cl.[5] ..... B65D 45/32

[52] U.S. Cl. ..... 215/226; 215/272; 215/274; 220/321; 81/3.09

[58] Field of Search ..... 81/3.02, 3.15; 7/151; 215/226, 272, 228, 246, 275, 304; 220/321

[56] References Cited

U.S. PATENT DOCUMENTS

| | | | |
|---|---|---|---|
| 3,185,332 | 5/1965 | Greenstein | 81/3.15 |
| 4,044,637 | 8/1977 | Solica . | |
| 4,193,508 | 3/1980 | Cziraki | 215/226 |

FOREIGN PATENT DOCUMENTS

| | | | |
|---|---|---|---|
| 171669 | 9/1934 | Switzerland | 215/272 |

*Primary Examiner*—Roscoe V. Parker

*Attorney, Agent, or Firm*—Fleit, Jacobson, Cohn, Price, Holman & Stern

[57] ABSTRACT

A device for opening a bottle and forming a closure cap for the bottle as a replacement for the removed crown cap. The bottle opener and closure cap includes a split metal ring that encloses a circular metal disc and resilient sealing member which are placed on top of a bottle that has its crown cap removed by the opener. The opener is formed in a handle which has a cam arrangement associated therewith to clamp the ring around the open end of a bottle. The ring includes an inwardly inclined bottom edge to engage a rib on the end of the bottle to cam the disc and sealing member downwardly in tight relationship to the open end of the bottom thereby forming a secure and positive closure cap for the bottle. The pivotal handle includes an opener incorporated therein by which a crown cap can be removed from the bottle.

1 Claim, 1 Drawing Sheet

BOTTLE OPENER AND CLOSURE CAP

BACKGROUND OF THE INVENTION

Field of the Invention

The present invention relates to a device for opening a bottle and forming a closure cap for the bottle as a replacement for the removed crown cap. The bottle opener and closure cap includes a split metal ring that encloses a circular metal disc and resilient sealing member which are placed on top of a bottle that has had its crown cap removed by the opener. The opener is formed in a handle which has a cam arrangement associated therewith to clamp the ring around the open end of a bottle. The ring includes an inwardly inclined bottom edge to engage a rib on the end of the bottle to cam the disc and sealing member downwardly in tight relationship to the open end of the bottle thereby forming a secure and positive closure cap for the bottle. The pivotal handle includes an opener incorporated therein by which a crown cap can be removed from the bottle.

Information Disclosure Statement

It is well known that when carbonated beverages, beer and the like are opened, the carbonation will gradually exit from the liquid beverage and the beverage will become "flat". In bottles for carbonated beverages, a crown cap is used in many instances and it is extremely difficult to reclose the bottle after the crown cap has been removed. To some extent this problem has been solved by the use of a screw threaded cap associated with plastic bottles. However, returnable glass bottles still are constructed with a peripheral rib at the upper end to which a crown cap is applied in sealed relation to retain the beverage in desirable condition during storage. When the crown cap is removed, the beverage in the bottle is usually consumed. However, in many instances, the contents of the bottle are only partially consumed and it is desirable to save the remainder of the beverage for consumption at a later time. If the bottle is left in an open condition, the beverage will lose its carbonation and become flat and less desirable. While efforts have been made to overcome this problem, none of the prior patents disclose the specific structure of this invention which basically forms a closure cap to replace the removed crown cap on a bottle.

The following U.S. patents are relevant to this invention but do not disclose the specific structural details and do not operate in the same manner.

| | |
|---|---|
| 2,046,804 | 2,801,557 |
| 2,646,705 | 4,026,170 |
| 2,682,985 | 4,044,637 |

SUMMARY OF THE INVENTION

An object of the present invention is to provide a closure cap for a bottle which replaces a removed and discarded crown cap in order to seal the bottle and retain the product in the bottle in a more desirable condition for later consumption with the device also including a structure to facilitate opening of the bottle by removing the crown cap.

Another object of the invention is to provide a bottle opener and closure cap in which the closure cap includes a split metal ring having a cam handle pivotally attached thereto by which the split metal ring can be collapsed into clamping relation to the crown neck of a bottle in lieu of the usual crown cap with the split ring receiving a circular metal disc and a circular seal underlying the disc and associated with the split ring in a manner to have the disc and seal cam downwardly into tight sealing engagement with the neck of the bottle thereby forming a sealed closure for the bottle.

A further object of the invention is to provide a bottle opener and closure cap in accordance with the preceding objects in which the split ring includes a pair of laterally extending ends generally in parallel relation to each other with a handle being pivoted thereto with the handle including cam elements engaged with the laterally extending ends of the split ring to move the laterally extending ends towards and away from each other to clamp and unclamp the split ring in relation to the neck of the bottle.

Yet another object of the invention is to provide a bottle opener and closure cap in accordance with the preceding objects in which the bottle opener can be of various configurations and the closure cap includes a relatively simple but dependable structure for securely clamping the closure cap in place for maintaining the bottle in sealed condition to maintain carbonation in the beverages contained in the bottle.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 4:
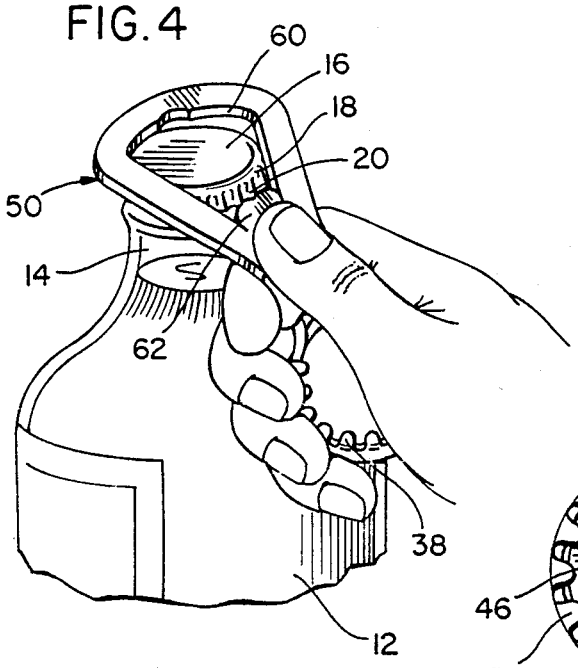
FIG. 4 is a perspective view illustrating the bottle opener being used to remove a crown cap from a bottle which is discarded and replaced by the closure cap.

The bottle opener and closure cap of the present invention is generally designated by reference numeral 10 and is mounted on a conventional beverage bottle 12 having a neck 14 constructed in a manner to receive a conventional crown cap 16 as illustrated in FIG. 4 with the crown cap being circular and provided with a depending skirt or flange 18 that is crimped at 20 to secure the crown cap to the neck 14 of the bottle 12 which includes a rounded upper end portion 22 that is defined by a groove 24 and an outwardly bulged portion 26 which represents a conventional crown cap bottle with the crown cap also being conventional and being removed by the bottle opener and closure cap 10 as illustrated in FIG. 4 with the crown cap 16 then being discarded and the bottle opener and closure cap effectively replacing the crown cap and forming a sealed closure for the bottle 12.

Figure 2:
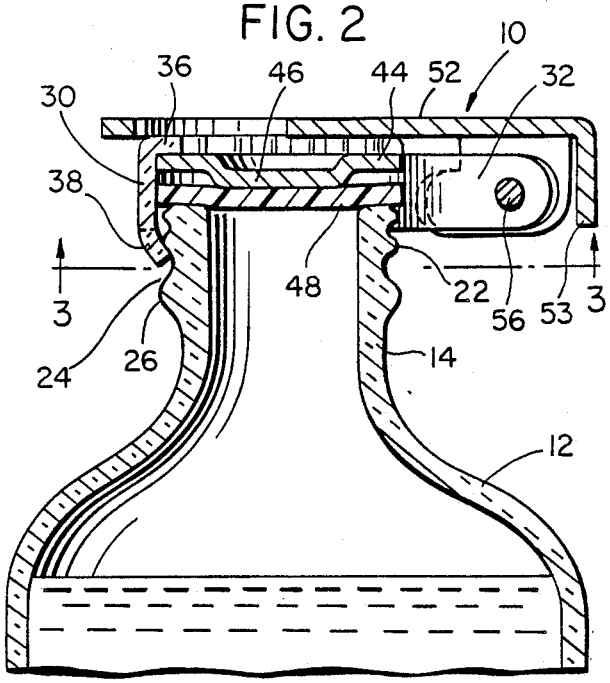
FIG. 2 is a vertical sectional view, on an enlarged scale, taken along section line 2—2 on FIG. 2 illustrating the specific structural details of the bottle opener and closure cap of this invention.
Figure 3:
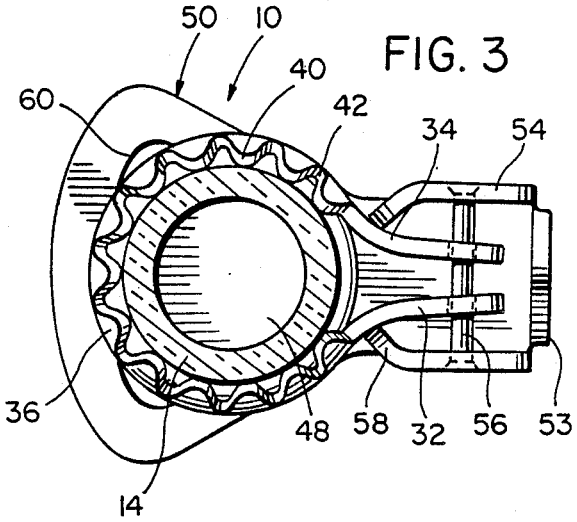
FIG. 3 is a bottom plan view of the bottle opener and closure cap taken along section line 3—3 on FIG. 2 illustrating further structural details of the device.

The bottle opener and closure cap includes a split metal ring 30 having a substantial vertical height as illustrated in FIG. 2 and a pair of laterally extending ends 32 and 34 as illustrated in FIGS. 3 and 4. The top edge of the split ring 30 is provided with inturned tabs 36 and the bottom edge thereof is provided with a plurality of inwardly extending inclined tabs 38 which have rounded lower ends 40 and rounded juncture edges 42 so that the tabs 38, when assembled on the bottle, will extend under and serve as camming devices associated with the peripheral ridge 22 on the neck 14 of the bottle 12. Positioned under the tabs 36 is a rigid metal disc 44 of circular configuration that has a downwardly offset central circular portion 46. Positioned under the disc 44 is a resilient circular sealing member 48 which is flat in construction and is replaceable and will be at least partially deformed by the downwardly offset central portion 46 of the disc 44 as illustrated in FIG. 2 when the split ring 30 is clamped into sealing engagement with the bottle neck 14 by a handle structure generally designated by the numeral 50.

Figure 1:
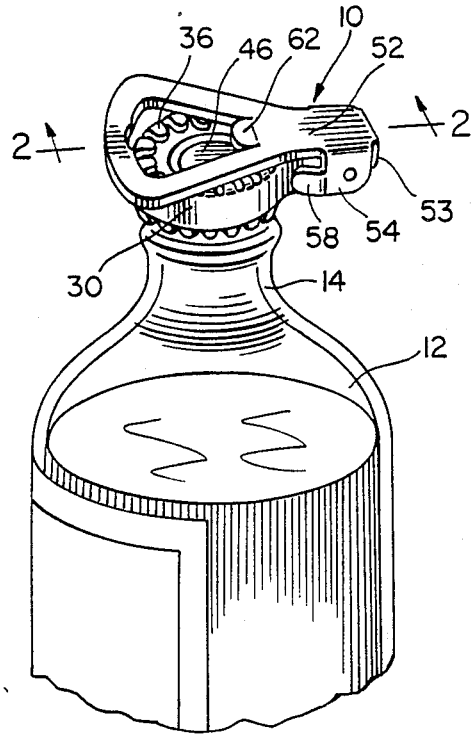
FIG. 1 is a perspective view of the bottle opener and closure cap illustrating its position on the neck of a bottle for maintaining the bottle in closed and sealed relation.
Figure 5:
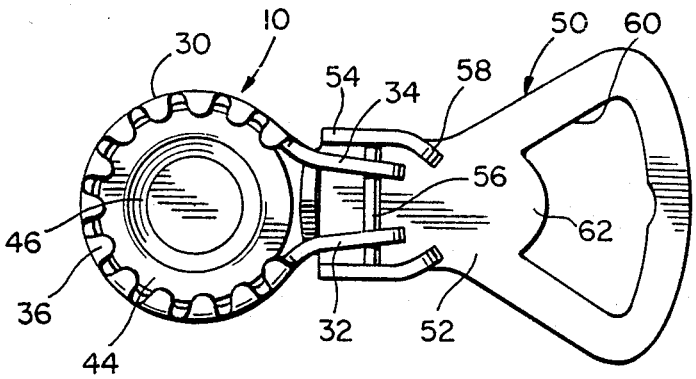
FIG. 5 is a top plan view of the bottle opener and closure cap illustrating the handle in open position.

The handle structure 50 includes a plate-like structure 52 that tapers to a narrow portion provided with laterally extending ears 54 which straddle the free ends 32 and 34 of the split ring and are pivotally secured thereto by a pivot pin 56 as illustrated in FIGS. 2, 3 and 5. The ears 54 are provided with inwardly inclined cam members 58 which in one position are in alignment with and engage the outer surface of the laterally projecting ends 34 and 32 as illustrated in FIG. 3 so that the ends 32 and 34 are moved inwardly to clamp the split ring 30 in secure clamping engagement with the neck 14 of the bottle. In the position as described, the plate-like structure 52 extends against the upper surface of the tabs 36 as illustrated in FIGS. 1 and 2 and the inturned ends 58 forming the cam structure engages and is aligned with the laterally extending ends 32 and 34 as illustrated in FIG. 3 thus bringing the ends 32 and 34 closer together for clamping the split clamp in place. When the handle 50 is pivoted upwardly for approximately at least 90° and as much as 180°, the cam elements 58 become disengaged from the ends 32 and 34 as illustrated in FIG. 5 so that the inherent resiliency of the split metal ring 30 causes the ends 32 and 34 to move apart thus unclamping the split ring from the bottle to permit removal of the closure cap and to permit assembly of the closure cap onto the bottle. Once the cap has been assembled onto the bottle, the handle 50 is pivoted from the position illustrated in FIG. 5 to the position illustrated in FIGS. 1–3 and the bottle is thus closed and sealed to retain the carbonated beverage in a condition that it can be subsequently consumed without permitting the escape of the carbonating agent.

FIG. 4 illustrates the bottle opener and closure cap being used to remove the existing crown cap 16 and this is accomplished by providing a generally triangular shaped aperture 60 in the plate 52 with a tab 62 formed in the inner apex of the triangular opening 60 so that the tab 62 can extend under the bottom edge of the flange or skirt 18 on the closure cap 16. The plate 52 has a lateral stop flange 53 that extends between the ends 32 and 34 with upward pivoting of the aligned handle and split ring removing the crown cap 16 in a well-known manner.

The bottle opener and closure cap provides a spill proof and air tight seal that will enable a carbonated beverage to retain its taste characteristics and effervescence for a long period of time even after the bottle has been opened and the existing crown cap discarded. The device is especially useful when applied to carbonated beverages, beer, champagne and the like in which it is desirable to seal the bottle after it has been initially opened and a portion of the contents consumed. This enables the contents of the bottle to be consumed in subsequent stages rather than being consumed all at one time and enables the taste and effervescent characteristics of the beverage in the bottle to be maintained even though the original crown cap has been removed.

The bottle opener and closure cap can be used when in the open position to remove a crown cap as illustrated in FIG. 4. The bottle opener and closure cap can then be placed on top of the bottle when in an open position as illustrated in FIG. 5 and the handle 50 then pivoted from the open position to the closed position with this pivoting movement causing the inturned cam ends 58 to engage the outer surface of the laterally extending ends 32 and 34 of the split ring 30 thus clamping the split ring 30 and causing the tabs 38 to engage the rim and the opening on the neck in a manner to pull the split ring down thus causing the tabs 36 to move downwardly and securely seal the neck of the bottle by forcing the metal disc down into tight clamping engagement with the sealing member 48.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A closure cap for a bottle from which a crown cap has been removed to form an air tight sealed closure for the bottle comprising a split ring of cylindrical configuration and provided with laterally extending converging spaced ends, said split ring having a length to span a peripheral rib on the neck of a bottle and including inwardly extending flange means at its upper end and downwardly and inwardly inclined flange means on its lower end, a disc-like seal assembly enclosed by the split ring in underlying relation to the flange means at the upper end of the split ring for sealingly engaging the end of the neck of a bottle and manually operated means connected to the laterally extending ends of the split ring to clamp and unclamp the split ring in relation to the neck of the bottle with the inclined flange means at the lower end of the split ring camming the split ring and seal assembly inwardly on the bottle to clamp the split ring in place and move the seal assembly into sealing engagement with the neck of the bottle, said means connected to the laterally extending ends including a handle, means pivotally mounting the handle to the outer ends of the laterally extending ends of the split ring and cam means on the handle engaging the laterally extending ends on the split ring for biasing the ends of the split ring towards each other when the handle is moved to a closed position and enabling the ends to move away from each other when the handle is in open position, said handle including a pair of tabs straddling the laterally extending ends of the split ring, said tabs being pivotally connected to the laterally extending ends of the split ring by a pivot pin extending therethrough, said cam means biasing the ends of the split ring including inturned cam ends on the tabs for engagement with the outer surface of the ends of the split ring to move the ends of the split ring towards each other for clamping engagement with the neck of the bottle, said handle being a flat plate-like structure having an enlarged opening formed therein with one end of the opening adapted to engage the upper surface of a crown cap on a bottle and a remote portion of the opening having an inwardly extending tab to extend under and engage the bottom edge of a crimped skirt portion of a crown cap on a bottle to enable the crown cap to be removed and discarded and the closure cap placed on the bottle in lieu of the removed crown cap, the flange means on the upper end of the split ring being formed by a plurality of horizontally extending tabs extending around a major portion of the perimeter of the split ring, the flange means on the lower end of the split ring including downwardly and inwardly inclined tabs having arcuate edge portions for engaging the undersurface of the peripheral rib on the neck of a bottle, said seal assembly including a rigid metal disc of circular configuration engaging the interior of the flange means on the upper end of the split ring, a circular resilient seal member underlying the disc and engaged with the neck of the bottle for sealing the bottle when the split ring is in clamped position on the neck of the bottle, said disc including a downwardly offset circular central portion to deform the central circular portion of the seal member slightly into the end of the neck of the bottle for secure sealing engagement therewith.

* * * * *